US010105284B2

(12) United States Patent
Collins et al.

(10) Patent No.: US 10,105,284 B2
(45) Date of Patent: Oct. 23, 2018

(54) ROTATING BLISTER DISPENSER

(71) Applicant: FONTEM HOLDINGS 3 B.V., Amsterdam (NL)

(72) Inventors: Fiona Collins, Hamburg (DE); Günter Wissmann, Schenefeld (DE)

(73) Assignee: FONTEM HOLDINGS 3 B.V., Amsterdam (NL)

( * ) Notice: Subject to any disclaimer, the term of this patent is extended or adjusted under 35 U.S.C. 154(b) by 0 days.

(21) Appl. No.: 15/387,369

(22) Filed: Dec. 21, 2016

(65) Prior Publication Data

US 2017/0181928 A1 Jun. 29, 2017

(30) Foreign Application Priority Data

Dec. 23, 2015 (EP) ..... 15202441

(51) Int. Cl.
*A61J 1/03* (2006.01)
*B65D 5/54* (2006.01)
(Continued)

(52) U.S. Cl.
CPC ..... *A61J 1/035* (2013.01); *B65D 5/54* (2013.01); *B65D 75/367* (2013.01);
(Continued)

(58) Field of Classification Search
CPC ..... B65D 75/36; B65D 83/0454; B65D 5/54; B65D 7/367; B65D 75/327; B65D 75/3275; A61J 1/035; A61J 1/03
(Continued)

(56) References Cited

U.S. PATENT DOCUMENTS 3,276,573 A * 10/1966 Kaufman ..... A61J 7/04 116/308
3,603,453 A * 9/1971 Serrell ..... B65D 75/54 206/445
(Continued)

FOREIGN PATENT DOCUMENTS

BE 1003274 A6 2/1992
DE 6933649 U 4/1970
(Continued)

OTHER PUBLICATIONS

European Patent Office, "Extended European Search Report", for EP15202441.0, dated Jun. 2, 2016, 6 pgs.

*Primary Examiner* — Steven A. Reynolds
(74) *Attorney, Agent, or Firm* — Perkins Coie LLP; Kenneth H. Ohriner

(57) ABSTRACT

The present invention relates generally to dispenser packs (10) and in particular rotating blister dispenser packaging structures. A dispenser pack (10) includes at least one circular blister pack (12) including blister cavities (14), wherein the blister cavities (14) are arranged along the circumference of the blister pack (12), and a casing (18) in the form of a closed box, wherein two of the opposite surfaces (A, B) of the casing (18) are square and a corner (C) of the casing (18) is removable for providing an opening (20) in the casing (10). The diameter D of the blister pack (12) is equal to the side lengths L of the two opposite surfaces (A, B) of the casing (18). The blister pack is rotatably mounted inside the casing (18) such that the axis of rotation passes through the center of the blister pack (12). The opening (20) provides access to at least one of the blister cavities (14).

18 Claims, 5 Drawing Sheets

(51) Int. Cl.
*B65D 75/36* (2006.01)
*B65D 77/04* (2006.01)
*B65D 83/04* (2006.01)

(52) U.S. Cl.
CPC ..... *B65D 77/0413* (2013.01); *B65D 83/0454* (2013.01); *B65D 83/0463* (2013.01)

(58) Field of Classification Search
USPC ..... 206/531, 538, 528, 533, 532, 704; 221/25
See application file for complete search history.

(56) References Cited

U.S. PATENT DOCUMENTS 3,659,706 A * 5/1972 Serrell ..... B65D 83/0445 206/445
5,551,597 A * 9/1996 Lambelet, Jr. ..... B65D 83/0454 206/531
8,490,794 B2 * 7/2013 Kalin ..... A61J 1/03 206/468
2003/0209558 A1 * 11/2003 Cross ..... B65D 83/0463 221/25
2004/0035876 A1 2/2004 Lo et al.
2007/0039851 A1 * 2/2007 Rasanen ..... B65D 83/0463 206/531
2009/0139894 A1 * 6/2009 Bitner ..... A61J 1/035 206/531
2012/0145739 A1 * 6/2012 Doyle ..... A61J 1/035 221/89
2012/0160731 A1 * 6/2012 Aldridge ..... B65D 83/0463 206/534

FOREIGN PATENT DOCUMENTS

DE 1586781 A1 8/1970
WO 0187732 A1 11/2001
WO 2005002491 A1 1/2005

* cited by examiner

ROTATING BLISTER DISPENSER

CROSS REFERENCE TO RELATED APPLICATIONS

This application claims the benefit of European Patent Application No. 15202441.0, filed Dec. 23, 2015, which is incorporated herein by reference.

FIELD OF INVENTION

The present invention relates generally to dispenser packs and in particular rotating blister dispenser packaging structures.

BACKGROUND OF THE INVENTION

A dispenser pack is a specific type of packaging. It is typically used for disposable or one-time products when they have to be supplied to a consumer under sanitary conditions. Dispenser packs often contain large quantities of identical products or goods within a single packaging. The consumer typically has only sequential access to single items and can use them one after another. In a typical kind of bulk pack, for example, the pack must be shaken by the consumer to release single products through a pour spout. This ensures that the dispensed items are always sanitary fresh. The scope of application for dispenser packs is not limited to a specific kind of product. They can directly be stored inside the dispenser pack. However, often they are further protected against each other by an additional individual packaging. This kind of packaging can be provided by so-called blister packs, a pre-formed packaging foremost used for small consumer goods, foods, and pharmaceuticals. The blister packs are typically made of cold or thermoformed plastics. They provide multiple blister cavities in which small doses of a product can be deposited and stored. By sealing the blister pack with a metal foil or another suitable cover layer, the enclosed items can be protected against environmental influences such as humidity, light exposure or contamination with, e.g., dust, dirt and bacteria. As the items are removed from such a blister pack by pushing them through the sealing one by one, such kind of packaging is also referred to as push-through-pack (PTP).

The goods provided by a dispenser pack are typically numerable. Often they dispense small individual doses of a single product in solid form (e.g., pills, mints, chewing gum). However, to provide the possibility of product choice to the consumer, also different types or kind of products may be contained within a single dispenser packaging structure. This can be done by filling the individual blister cavities with a whole range of different products or by combing multiple blister packs for allowing different products to be in a single dispenser pack. Preferably, such a dispenser pack should provide easy and convenient access to the individual types of products wherein the consumer is not required to perform any burden and cumbersome product selection and release processes. On the other hand, the production and filling process of the dispenser pack should base on standard industrial processing techniques and must be efficient and cost effective to the manufacturer.

SUMMARY OF THE INVENTION

A dispenser pack has at least one circular blister pack including blister cavities arranged along the circumference of the blister pack, and a casing in the form of a closed box, wherein two of the opposite surfaces of the casing are square and a corner of the casing is removable for providing an opening in the casing. The diameter D of the blister pack is equal to the side lengths L of the two opposite surfaces of the casing. The blister pack is rotatably mounted inside the casing such that the axis of rotation passes through the center of the blister pack. The opening provides access to at least one of the blister cavities.

A circular blister pack in combination with a size-fitted casing allows an internal rotation of the blister pack along the inner sides of the casing without requiring any physical axis of rotation on which the rotation of the blister pack is performed. By arranging the blister cavities along the circumference of the blister pack, the circulation takes place near the outer edges of the casing. Therefore, it is possible to provide an access to the blister cavities of the blister pack by simply providing an opening in one corner of the casing. The size of the opened corner segment and the density of blister cavities then define how many blister cavities are accessible at once.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DETAILED DESCRIPTION

Figure 1:
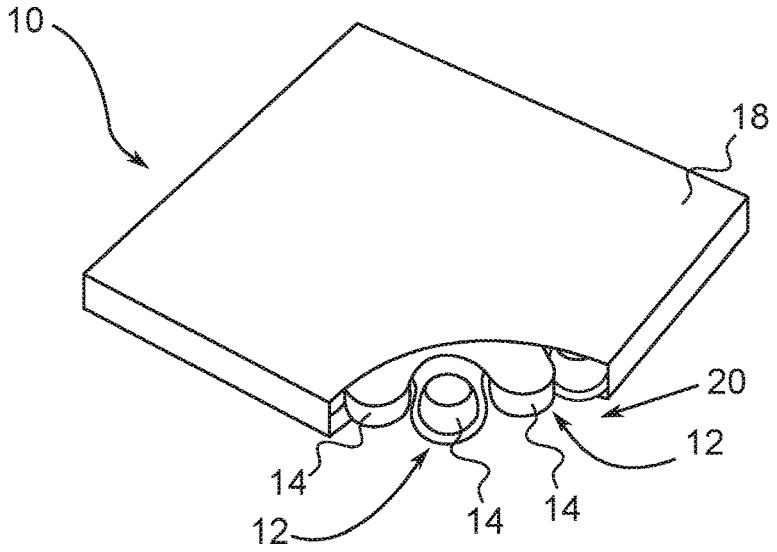
FIG. 1 is a perspective illustration of an exemplary dispenser pack.

In FIG. 1, a perspective illustration of an exemplary dispenser pack 10 is shown. Two circular blister packs 12 having individual blister cavities 14 are encased by a size-fitted casing 18. The individual blister cavities 14 are located at the outer edge of each blister pack 12. They are arranged in a manner that the blister cavities 14 of the two blister packs 12 are pointing in opposite directions. However, it is also possible having a single blister pack 12 with the blister cavities 14 pointing in different directions. Furthermore, the blister cavities 14 can all point into a single direction. They can as well be provided on just a single blister pack 12 or as a combination of different blister packs 12. Such a combination can be achieved by an interlocked layering of different blister packs 12 such that the individual blister cavities 14 of all constitute blister packs 12 row up along the circumference of the combined blister pack 12 structure.

The blister cavities 14 can contain small individual doses of at least one product in solid or liquid form. The blister cavities 14 can also be filled with a single product. Different products can be combined into single blister cavities 14 or the blister packs 12 are filled with only a single product per blister cavity 14. If different blister packs 12 are combined with each other, they comprise at least one of the filling options. Furthermore, liquid and solid blister cavity 14 fillings can be combined in a single dispenser pack 10. In a dispenser pack 12, two different products from one packaging structure can be independently dispensed. It is further preferred that the blister cavities 14 would be filled with two different flavors of just a single product.

The casing 18 has the form of a closed box. It is preferably made from cardboard or plastics. The material of the casing 18 can also be or comprise a metal. The diameter D of the blister packs 12 exactly matches with one side length L of the casing 18 such that the blister packs 12 perfectly fit into the inner cavity of the casing 18. Any mechanical movement, except a possible rotation of the blister packs 12 inside the casing 18, is inhibited. The visible parts of the blister packs 12 are exposed by an opening 20 of the casing 18. The opening 20 can be provided by fully removing one corner of the casing 18. It is also possible to provide the opening 20 by a shutter. In this case, the removable corner is just partly removable and keeps always attached to the casing 18 for providing a hinge structure for a closable opening 20. However, it is possible to access individual blister cavities 14 of the blister packs 12 inside the casing 18 through the opening 20. This allows releasing single products or goods which are stored inside the individual blister cavities 14. Furthermore, it enables the consumer to apply a rotational force to the blister packs 12 for selecting the different blister cavities 14 of the blister pack 12. All blister cavities 12 can thus be freely positioned by the costumer and then sequentially accessed in the opening 20 of the casing 18.

Figure 2:
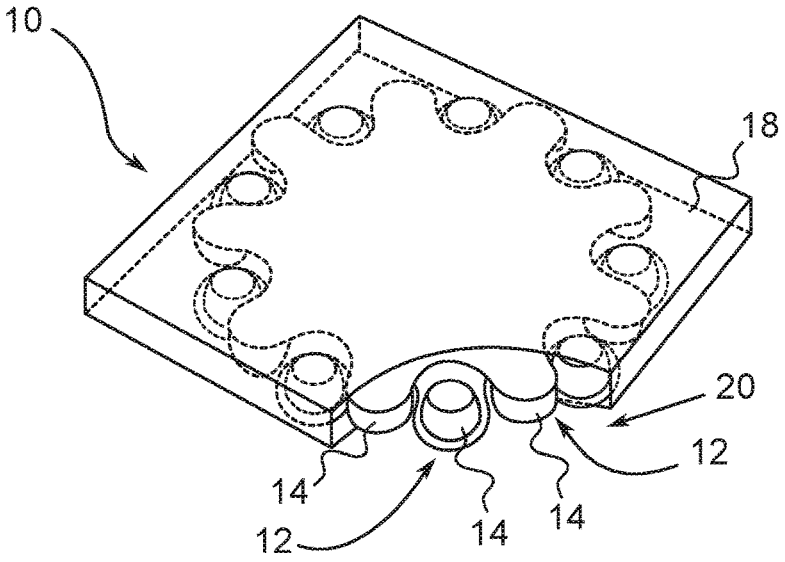
FIG. 2 is a semitransparent perspective illustration of an exemplary dispenser pack.

In FIG. 2, a semitransparent perspective illustration of an exemplary dispenser pack 10 is shown. The dispenser pack 10 corresponds to an embodiment as described in the previous section. The references are in agreement with the assignments made in the previous figure. The casing 18 is semitransparent and allows visualizing the hidden parts of the blister pack 10. It shows that two reversely interlocked circular blister packs 12 are inside the casing 18. They are arranged in such a manner that the different blister cavities 14 are lined up along a common circumference of the combined two blister packs 12. This is basically achieved by incorporating a circular distance between two successive blister cavities 14 on the first blister pack 12. A blister cavity 14 located on the second blister pack 12 can then fit into this space.

The illustration clearly shows that there is no physical axis of rotation is required. Instead, there is a virtual axis of rotation caused by the four peripheral contact points of the interlocked blister pack 12 with the inner surfaces of the casing 18. For that, the side lengths L of the casing 18 correspond to the diameter D of the rotating blister packs 12. The virtual axis of rotation passes through the center of the circular blister packs 12. It is perpendicularly aligned to the two square surfaces of the casing 18 and the surfaces of the blister pack 12. The plane of rotation is thus parallel to the square surfaces of the casing 18. In another embodiment of the invention, the virtual axis of rotation can also be tilted. In yet another embodiment of the invention, a physical axis of rotation can be provided by a suitable guiding structure.

The blister packs 12, which are circular and carrying blister cavities 14 along their circumference, can be otherwise arbitrarily structured. Blister packs 12 with different structures can also be combined in a dispenser pack 10. The principle of rotating blister packs 12 inside dispenser pack 10 is thus not limited to a specific type of blister pack 12. Especially, single or multiple blister packs 12 with blister cavities 14 pointing in the same or different directions are possible. The opening 20 in the casing 18 provides access to at least one of the blister cavities 14 at a time. It depends on the overall size of the casing 18 and the size of the individual blister cavities 14 how large the opening 20 must be. The blister cavities 14 can have different sizes.

Figure 3:
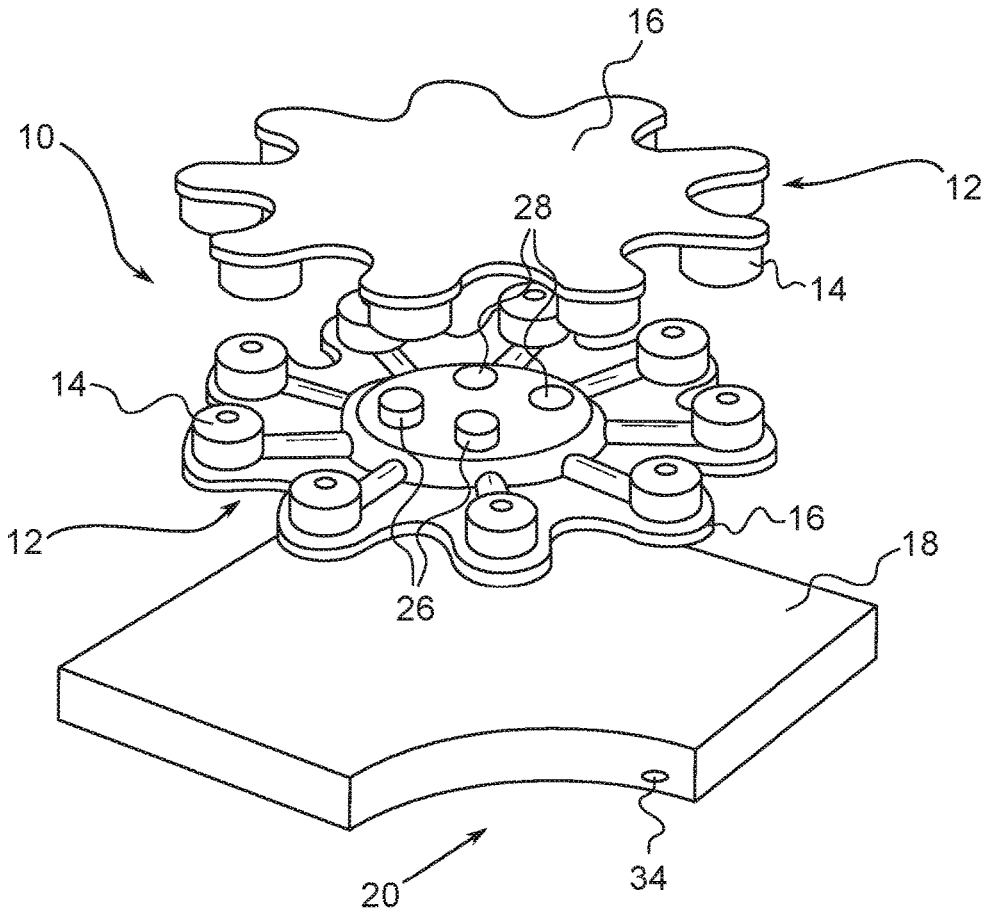
FIG. 3 is an exploded view of an exemplary dispenser pack.

In FIG. 3, an exploded view of an exemplary dispenser pack 10 is shown. The illustrated dispenser pack 10 corresponds to an embodiment as described in the previous sections. The references are in full agreement with the assignments made in the previous figures. In this exploded view the arrangement of the individual blister packs 12 can be observed in detail. The blister packs 12 can be produced by standard industrial vacuum forming techniques. After filling the blister cavities 14, the blister packs can be sealed by a lidding foil 16, preferably made of metal, plastics, or a compound material thereof, in a standard blister sealing process. In the shown embodiment both blister packs 12 are identical and could therefore be produced using the same tooling and filling processes. This can boast production efficiency and cost benefits as all production steps are based on standard processes which allow the total costs to reduce quicker as the production volume increases.

The two blister packs 12 of this specific embodiment can be interlocked by their front-sides facing to each other. The respective interlocking can be achieved by the geometrical structure of the blister pack 12. For instance, the individual blister cavities 14 of both blister packs 12 can be engaged via dovetailing. A fixture between both blister packs 12 is not required as the engagement and the casing 18 ensure structural stability. For increased stability, the different blister packs 12 can be further engaged by additional alignment elements which can be directly patterned on the surfaces of the blister packs 12. The blister packs 12 may comprise at least one alignment element for interlocking different blister packs 12. An example for such alignment elements are corresponding pairs of alignment pins 26 and alignment holes 28. Preferably, the alignment element comprises one or two alignment pins 26 and a corresponding number of alignment holes 28. They can be formed to allow nested or hooked connections between different blister packs 12. Exemplarily, two pairs of such alignment pins 26 and alignment holes 28 are shown in the figure. The blister packs 12 can thus be assembled to create a disk which allows the independent dispensing of products at opposite sides of a dispenser pack 10. One flavor of a single product may be dispensed on one side and, after flipping onto the reverse of the dispenser pack 12, the customer has the option to dispense another flavor of the same product. The opening 20 in the casing 18 provides access to exact two successive blister cavities 14 which individually dispense products in opposite directions.

Dispenser packs 10 can further comprise a latch 34 for rotation click-stop. The latch 34 can be, as shown here, positioned inside the casing 18. It can also be an integral part of the casing 18. Furthermore, the latch 34 can be located on or be part of the blister packs 12. When constantly turning the blister packs 12, the latch 34 can provide specific click-stop positions or states on which the rotation can be locked. These positions are set such that at least one of the individual blister cavities 14 is directly accessible for the customer at the opening 20 of the casing 18.

Figure 4:
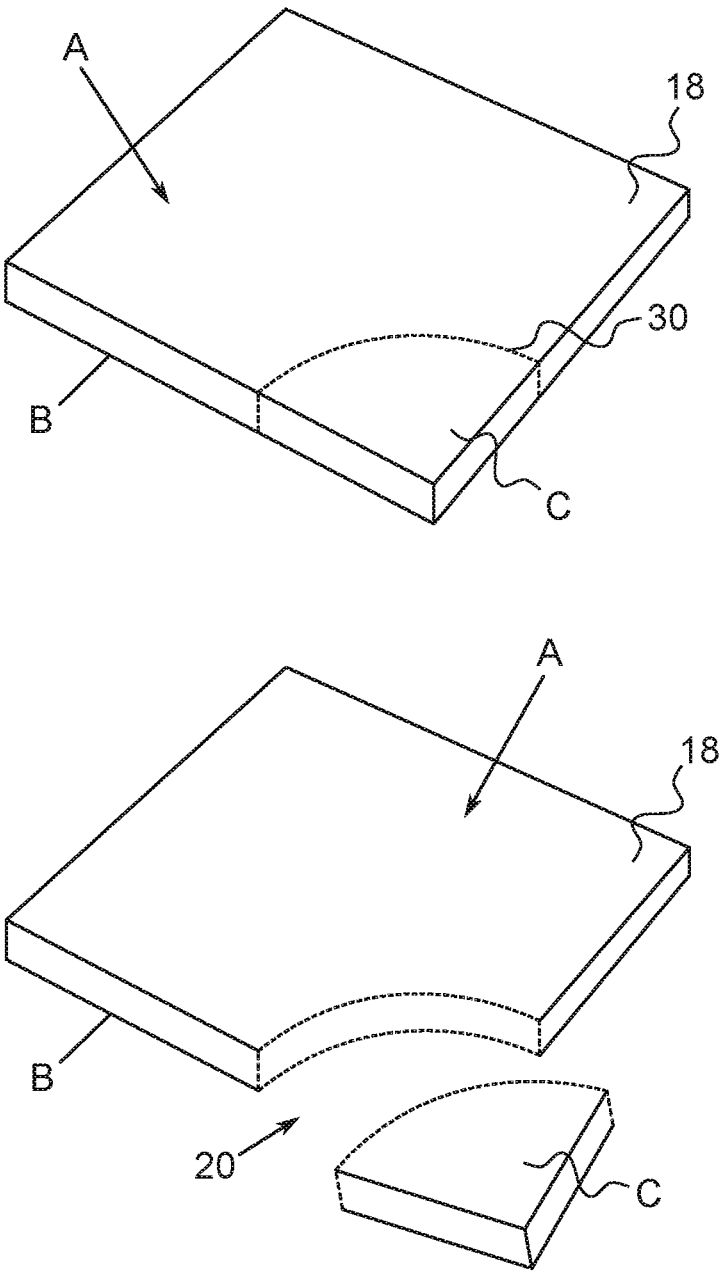
FIG. 4 is a schematic illustration of the casing of an exemplary dispenser pack.

In FIG. 4, a schematic illustration of the casing 18 of an exemplary dispenser pack 10 is shown. It presents the casing 18 with two opposite square surfaces A, B of side length L in a first closed state and in a second open state with a removed corner C providing an opening 20 in the casing 18. The consumer removes corner C before usage. The corner C can comprise perforations 30 which enable the costumer to simply pull off the corner C from the closed casing 18. The perforations 30 can further act as temper evidence during sale of a dispenser pack 10. The casing 18 may be further shrink wrapped by a suitable plastic foil.

Figure 5:
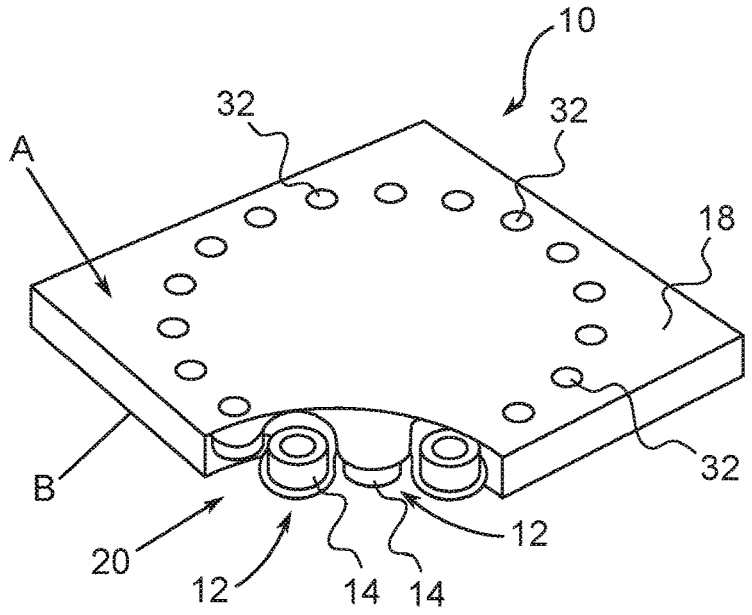
FIG. 5 is a perspective illustration of another embodiment of an exemplary dispenser pack.

In FIG. 5, a perspective illustration of another embodiment of an exemplary dispenser pack 10 is shown. The illustrated dispenser pack 10 corresponds to an embodiment as described in the previous sections. The references are in wide agreement with the assignments made in the previous figures. However, the casing 18 additionally comprises several view ports 32 in the form of windows or holes to allow visual inspection of the individual blister cavities 14 by a costumer without prior rotation of the blister pack 12. The view ports 32 can be only in a single side or on two sides of the casing 18. The position of the different view ports 32 preferably corresponds to the spatial distribution of the blister cavities 14 of the blister packs 12 such that all blister cavities 14 on a side can be inspected at once. Instead providing a number of individual view ports 32, a single annulus view port 32 along the ring of blister cavities 14 can also be used. Furthermore, the casing can comprise a transparent material which intrinsically allows observing the filling state of the blister cavities 14. The view ports 32 can allow the customers to see how many products are remaining in the dispenser pack 10.

Figure 6:
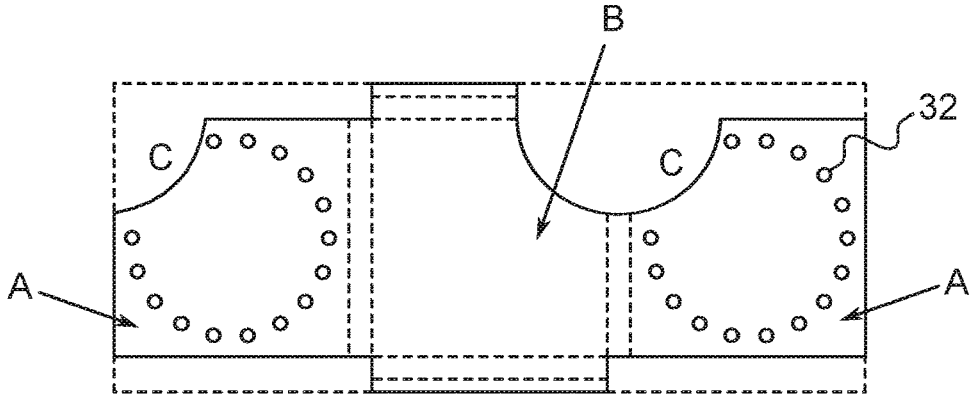
FIG. 6 is a schematic illustration of a casing structure of an exemplary dispenser pack.

In FIG. 6, a schematic illustration of a casing structure of an exemplary dispenser pack 10 is shown. The casing 18 of a dispenser pack 10 may be made of cardboard. The cardboard can be mechanically stamped according to the presented folding pattern. The pattern allows producing a casing 18 which corresponds to a casing 18 as shown in the previous figure. After folding along the dashed inner lines, the casing 18 can be glued at the two overlapping surfaces A. For simplification, the casing structure does not show a removable corner C. In this embodiment of a casing 18, view ports 32 are only installed in one of the surfaces, namely surface A, whereas the opposite surface B includes no view ports 32. However, the folded casing can also comprise no view ports 32 at all or view ports 32 on both surfaces A, B of the casing 18.

Figure 7:
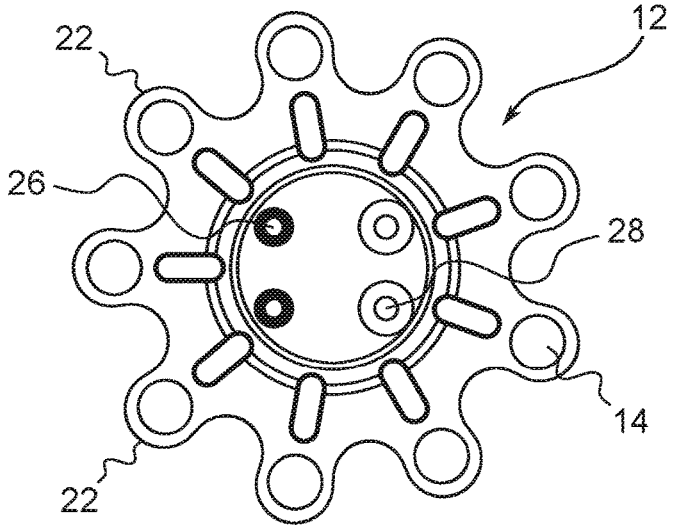
FIG. 7 is a schematic illustration of a exemplarily blister pack.

In FIG. 7, a schematic illustration of an exemplarily blister pack 12 is shown. It has a circular shape with an outer diameter D, which is preferably equal to or in the range of the side lengths L of a square casing 18. This allows clearance-free rotation of the blister pack 12 inside the casing 18 and avoids the need for a physical axis of rotation. The circular blister pack 12 comprises several blister cavities 14 arranged along the circumference of the blister pack 12. Each second blister cavity 14 is spared out such that the blister pack 12 is regularly star-shaped with an individual blister cavity 14 located on each tip 22. This allows for interlocking two of such star-shaped blister packs 12 with their front-sides facing to each other.

In the center of the blister pack 12, specific alignment elements are shown. They allow a simplified interlocking of two identical blister packs 12. In this embodiment, each blister pack 12 comprises two alignment pins 26 and two alignment holes 28. By bringing the front-sides of two identical blister packs 12 in close contact, there is a single angular position where these structures directly match to each other and where interlocking is possible. Alignment pins 26 and alignment holes 28 can be structured to fit into each other or they can be structurally modified to grab into each other. However, the form of the alignment elements is not limited to alignment pins 26 and alignment holes 28. Each alignment element which is able to define a specific mutual angular and spatial position can be applied. This includes elongated linear structures, spirals, notches and many more.

Figure 8:
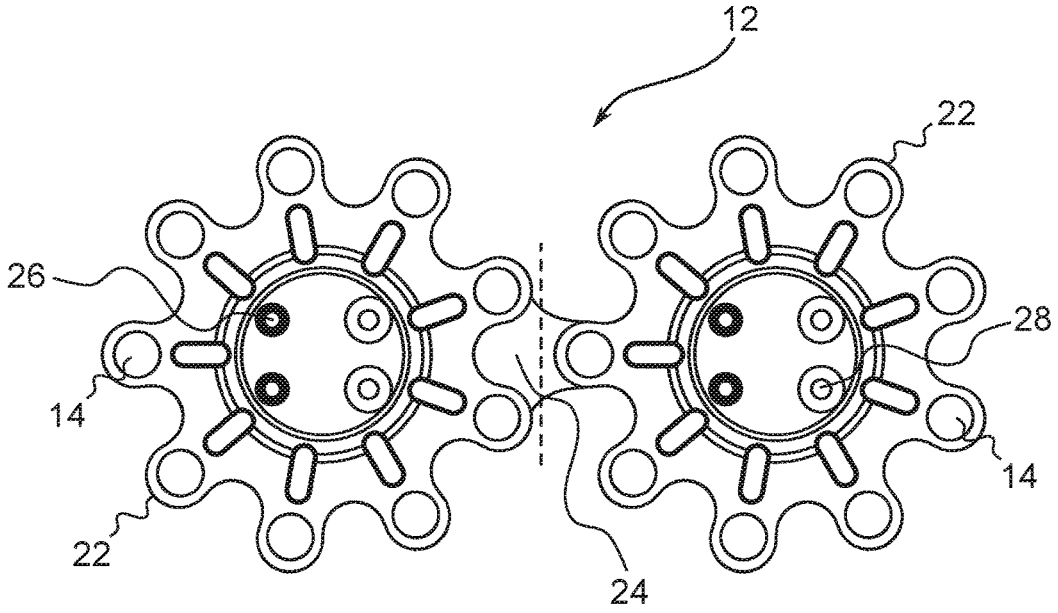
FIG. 8 is a schematic illustration of another embodiment of a blister pack.

In FIG. 8, a schematic illustration of another embodiment of a blister pack 12 is shown. The presented embodiment comprises all features of the previous figure. Therefore, the same references are used throughout the description. The blister pack 12 is comprised by two identical blister carriers. Each blister carrier has the shape of a blister pack 12 as shown in the previous figure. They are partly connected by a folding element 24 which allows these blister carriers to be interlocked by simply folding them onto each other along the dashed folding line. The two connected blister carriers are arranged such that, after folding, interlocking of the two blister packs 12 occurs. Thus, in this embodiment, a circular blister pack 12 is created by folding the two blister carriers onto each other. The advantage of such an embodiment of a single blister pack 12 could be a simplified production and filling process. No individual components have to be combined as it is required for interlocking two independent blister packs 12.

In summary, in one aspect the dispenser pack 10 can comprise two identical interlocked blister packs 12. An advantage may be that it can provide an innovative way to independently dispense two different products from one packaging structure. Each product can be individually sealed and is therefore not impacted by the dispensing of other products. The combined blister packs 12 could also be formed by a single element which has to be folded together to create an interlocked blister pack 12 configuration. According to another embodiment, the dispenser pack 10 can comprise view ports 32 for inspecting the individual blister cavities 14. In another embodiment, a latch 34 for rotation click-stop can be applied.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10 dispenser pack
12 blister pack
14 blister cavities
16 lidding foil
18 casing
20 opening
22 tip
24 folding element
26 alignment pin
28 alignment hole
30 perforations
32 view port
34 latch
A, B surfaces
C corner

The invention claimed is:

1. A dispenser pack comprising:

a casing having square and parallel top and bottom surfaces joined to four rectangular sides, with the rectangular sides perpendicular to the top and bottom surfaces;

a first blister pack contained within the casing, the first blister pack having a plurality of blister cavities, and side surfaces in sliding contact with substantially each of the four rectangular sides of the casing, allowing the first blister pack to rotate within the casing about a substantially fixed central axis, with no physical axis element at the central axis;

the casing having four corners, with each corner formed by a portion of the top and bottom surfaces and by a portion of two of the rectangular sides, with a corner of the casing removable from the casing or pivotally attached to the casing, to provide an opening in the casing.

2. The dispenser pack of claim 1 with the first blister pack comprising a plurality or equally spaced apart arms extending radially outward from a central section, and with one blister cavity on each of the arms.

3. The dispenser pack of claim 2 with each arm having a curved outer end, and with the curved outer ends of the arms forming the side surfaces in sliding contact with the four rectangular sides.

4. The dispenser pack of claim 2 further comprising a second blister pack attached to the first blister pack, with each blister cavity on the first blister pack in between adjacent blister cavities on the second blister pack.

5. The dispenser pack according to claim 4 wherein each second blister cavity along the circumference of the second blister pack is spaced out such that the second blister pack is star-shaped.

6. The dispenser pack according to claim 4 wherein the first blister pack comprises at least one alignment element for locking spatial positions of the first and second blister packs with respect to each other.

7. The dispenser pack according to claim 6, wherein the alignment element comprises one or two alignment pins and a corresponding number of alignment holes.

8. The dispenser pack according to claim 1 wherein the substantially fixed central axis is perpendicular to the side surfaces of the first blister pack.

9. The dispenser pack according to claim 1 wherein the opening in the casing provides access to two successive blister cavities individually dispensing in opposite directions.

10. The dispenser pack according to claim 1 wherein the first blister pack comprises plastic and/or metal.

11. The dispenser pack according to claim 1 wherein the casing is made from cardboard.

12. The dispenser pack according to claim 1 further comprising perforations passing around the edges of the opening for allowing simple removal of said corner.

13. The dispenser pack according to claim 1 wherein the casing comprises at least one view port for inspecting the individual blister cavities.

14. The dispenser pack according to claim 1 wherein the casing and/or the first blister pack comprises a latch for rotation click-stop.

15. A dispenser pack comprising:

a casing having square and parallel top and bottom surfaces joined to four rectangular sides, with the rectangular sides perpendicular to the top and bottom surfaces;

a first blister pack attached to a second blister pack within the casing, each blister pack having a plurality or equally spaced apart arms extending radially outward from a central section, and with a blister cavity on each of the arms, the arms of the first blister pack radially offset from the arms of the second blister pack;

each arm having a curved outer end in sliding contact with a central area of each of the four rectangular sides as the blister packs rotate with in the casing, to maintain the blister packs centered on a substantially fixed central axis, with no physical axis element at the central axis.

16. The dispenser pack of claim 15 with the blister cavities on the first blister pack projecting upward from the arms on the first blister pack, and with the blister cavities on the second blister pack projecting downward from the arms on the second blister pack, and with all of the blister cavities equally spaced apart on a common circumference.

17. The dispenser pack according to claim 15 wherein the first and second blister packs are interlocked with their front-sides facing each other.

18. The dispenser pack according to claim 17 wherein the first and second blister packs are partly connected by a folding element.

* * * * *